United States Patent [19]

Newcomb

[11] 4,222,053

[45] Sep. 9, 1980

[54] MULTI-BAND VERTICAL ANTENNA

[75] Inventor: Donald R. Newcomb, Lake Crystal, Minn.

[73] Assignee: Butternut Electronics Co., Lake Crystal, Minn.

[21] Appl. No.: 957,641

[22] Filed: Nov. 3, 1978

[51] Int. Cl.[2] ..... H01Q 5/00; H01Q 9/32

[52] U.S. Cl. ..... 343/722; 343/723; 343/745

[58] Field of Search ..... 343/722, 749, 756, 723, 343/745, 900, 901

[56] References Cited

U.S. PATENT DOCUMENTS

| | | | |
|---|---|---|---|
| 2,898,590 | 8/1959 | Pichitino | 343/722 |
| 3,089,140 | 5/1963 | Monola | 343/722 |
| 3,176,298 | 3/1965 | Nettles | 343/722 |
| 4,145,693 | 3/1979 | Fenwick | 343/722 |

*Primary Examiner*—Eli Lieberman
*Attorney, Agent, or Firm*—Hugh D. Jaeger

[57] ABSTRACT

A vertical antenna which is omnidirectional and includes completely automatic band switching for the amateur radio frequencies of one hundred and sixty meters, eighty-seventyfive meters, forty meters, twenty meters, fifteen meters, and ten meters. The vertical antenna has a low angle of radiation and a low standing wave ratio on all frequencies which permits direct coaxial cable transmission line feed. The eighty meter and forty meter resonator capacitor sections provide inductive reactance for operation on eighty-seventyfive meters and forty meters while permitting simultaneous resonance on each of the three higher frequencies of twenty, fifteen, and ten meters. The entire radiator length of the vertical antenna is active on all frequencies except for fifteen meters where the upper portion of the antenna is trapped out by a fifteen meter decoupling trap. A one hundred and sixty meter tuning unit for the vertical antenna employs a combination of fixed and variable inductance in a high-C parallel-tuned circuit to generate inductive reactance to resonate the vertical antenna on one hundred and sixty meters.

12 Claims, 5 Drawing Figures

MULTI-BAND VERTICAL ANTENNA

BACKGROUND OF THE INVENTION

1. Field of the Invention

The present invention relates generally to an antenna, and more particularly, pertains to a high frequency vertical antenna.

2. Description of the Prior Art

Those concerned with antennas have long recognized the need for a high frequency vertical antenna including automatic band switching. The present invention fulfills this need.

The traditional prior art vertical antennas have relied on anti-resonant inductor-capacitor circuit traps placed at or near the quarter-wave current antinode points to decouple varying lengths of the available radiating structure on those bands where the total height of the vertical antenna was greater than an electrical quarter wavelength. The approach provided that the overall height of the radiating structure was typically less than a quarter wavelength at the lowest frequency of operation and the exact height was largely determined by the inductance-capacitance ratio of the traps. The usual method to provide eighty meter resonance in vertical antennas was to utilize a high inductance coil at the top of the structure which simultaneously served as a forty meter decoupling trap and as a loading for eighty meter resonance. In most designs, additional loading in the form of capacity hats was used to limit the overall height of the structure to something less than one-eighth wavelength on the lowest frequency. The physical height of the active radiating sections was usually less than a quarter wavelength because of the inductive reactance of the several decoupling traps at frequencies below the frequencies which the decoupling traps were tuned.

The prior art vertical antennas have had a number of limitations. First, the active antenna height on all but the highest frequency band was necessarily less than one quarter wavelength resulting in a radiation resistance which progressively decreased from a high impedance on the highest frequency of operation to a few ohms on the lowest frequency of operation. Second, the use of numerous traps and other loading devices increased the system Q and unnecessarily restricted the bandwidth, especially on the mid-range HF (high frequency) frequencies where the active radiator height could be less than that required for unloaded resonance operation. Third, from a mechanical viewpoint, the use of numerous traps and loading devices in the upper sections of the vertical antenna made for a relatively unstable and heavy structure which required heavy and expensive construction for a freestanding wind survival rate. Fourth, a further difficulty had to do with the ease of adjustments for resonance at the desired frequencies in the low HF frequencies. Inasmuch as adjustment in the past for these frequencies had to be made in the upper sections of the antenna, the entire vertical antenna had to be removed from its mounting and brought to ground level for the slightest readjustment. This was a particularly inconvenient feature of operation as the effective operating bandwidth of the vertical antenna was generally less than twenty percent of the authorized band spectrum. Finally, the prior art vertical antennas could not easily or conveniently be extended to provide additional resonance on the one hundred and sixty meter band, as the additional height required greatly complicated the physical construction of the vertical antenna. Therefore, the prior art commercially available multi-band vertical antennas have not provided a simultaneous one hundred and sixty meter capability.

The present invention provides a vertical antenna that overcomes all the disadvantages of the prior art vertical antennas.

SUMMARY OF THE INVENTION

The general purpose of this invention is to provide a high frequency vertical antenna which is resonant on six amateur radio HF bands.

According to one embodiment of the present invention, there is provided a high frequency vertical antenna for use on the amateur radio high frequency spectrum segments having an eighty meter capacitor section and including an adjustable resonator connected across the capacitor section, a forty meter capacitor section connected to the eighty meter capacitor section and including an adjustable resonator connected across the capacitor section, a fifteen meter trap section connected to the forty meter capacitor section and an upper vertical radiating section connected to the fifteen meter trap section whereby the overall antenna height is resonated on eighty and forty meters, the vertical antenna resonates as a quarter wavelength on twenty meters, the vertical antenna resonates as a quarter wavelength on fifteen meters because of decoupling of the upper vertical radiating section of the antenna by the fifteen meter trap section, and the vertical antenna resonates as a three-quarters wavelength on ten meters.

A one hundred and sixty meter tuner can be added to the base of the vertical antenna for simultaneous resonance on all six HF amateur bands of one hundred and sixty meters through ten meters of the high frequency spectrum.

One significant aspect and feature of the present invention is a vertical antenna which is omnidirectional including completely automatic band switching, and can operate on all HF amateur frequencies of one hundred and sixty meters through ten meters.

Having briefly described one embodiment of the present invention, it is a principal object hereof to provide a vertical antenna for operation on the high frequency amateur radio frequencies of one hundred and sixty meters through ten meters. The frequency segments are one hundred sixty meters, eighty-seventyfive meters, forty meters, twenty meters, fifteen meters, and ten meters. While the present invention has been disclosed for use on the six amateur radio frequency segments of the high frequency spectrum, the specification is not to be construed as limiting as the principles of operation can be extended to any frequencies of operation as predetermined.

An object of the present invention is a vertical antenna which operates on all of the amateur radio HF spectrum assignments as set forth by the Federal Communications Commission and requires no manual band switching when changing frequencies. The band switching is automatic and electrical in the literal and figurative sense in that the entire height of the vertical antenna radiates on all frequencies except for fifteen meters where the upper portion of the antenna is automatic and electrically trapped out for quarter wavelength operation on fifteen meters. The automatic and electrical band switching eliminates the need for manual band switching from the physical antenna itself or from a remote point.

Another object of the present invention is to provide a vertical antenna with fewer traps or tuned circuits than the prior art vertical antennas thus simplifying the vertical antenna with resultant economies in time and construction materials. By utilizing resonator capacitor sections, fewer traps are required.

A further object of the present invention is to provide a vertical antenna having greater efficiencies because of the active radiating sections on the upper high frequency spectrum segments. Consequently, the bandwidth is increased on the upper high frequency spectrum segments because of the lower Q of the longer radiating sections for each of the spectrum segments, particularly the forty meters through ten meter bands.

An additional object of the present invention is to provide a vertical antenna which provides readily accessible in-place adjustment on the forty and eighty meter bands where the Q is the highest and where the bandwidth is typically much less than the entire band by moving a coil clamp along the vertical length of the eighty meter and forty meter resonator capacitor sections.

A still additional object of the present invention is to provide a vertical antenna which has small wind loading because the frequency control circuits are mounted in and on the lower half of the vertical antenna. The upper half of the antenna only needs to support its own weight thereby being much lighter and requiring smaller diameter metal tubing.

BRIEF DESCRIPTION OF THE DRAWINGS

Other objects and many of the attendant advantages of this invention will be readily appreciated as the same becomes better understood, by reference to the following detailed description when considered in connection with the accompanying drawings, in which like reference numerals designate like parts throughout the figures thereof and wherein.

DESCRIPTION OF PREFERRED EMBODIMENTS

Figure 1:
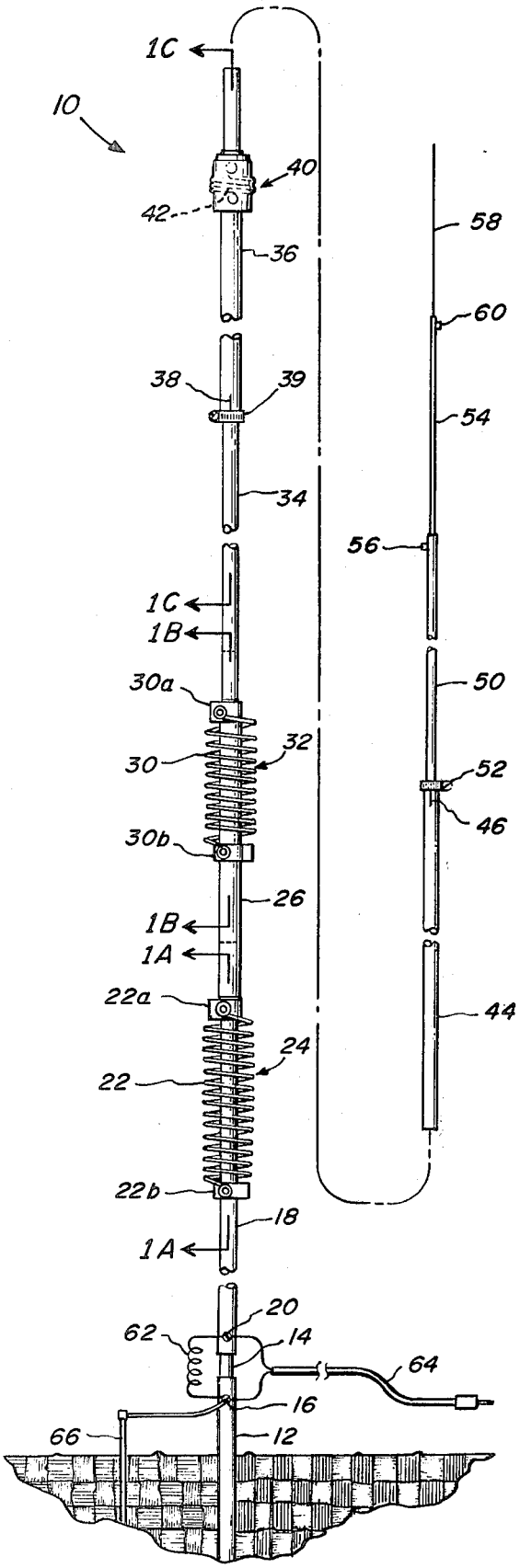
FIG. 1 illustrates a plan view of a vertical antenna, the present invention.

FIG. 1, which illustrates a vertical plan view of a vertical antenna 10, the present invention, shows a metal hollow tubular mounting post 12 having a solid tubular fiberglass insulator 14 of a diameter to telescope internally into the mounting post 12, and secured thereto with a nut and bolt assembly 16. An eighty-seventyfive meter resonator capacitor metal section 18 having a lower hollow tubular portion of a diameter telescopes over the solid insulator 14, and is secured thereto with a nut and bolt assembly 20. An eighty meter resonator coil 22 clamps between a top portion of the eighty meter resonator capacitor section 18 to a position immediately below an insulator assembly 24 as later described in FIG. 1A. Coil clamps **22*a* and 22*b* surround the top portion of the eighty meter resonator capacitor section 18, position immediately below the insulator assembly 24 respectively, and are secured thereto with nut and bolt assemblies in addition to securing the respective ends of the coil 22 as later described in FIG. 1A. A self-tapping screw 22*c* secures the top coil clamp 22*a* to the top portion of the eighty meter resonator capacitor section 18. A forty meter resonator capacitor metal section 26 having a lower hollow tubular lower portion of a diameter to telescope over the eighty meter resonator capacitor section above the insulator assembly 24, and secures thereto with a self-tapping screw 28. A forty meter resonator coil 30 clamps between a top portion of the forty meter resonator capacitor section 26 to a position immediately below an insulator assembly 32 as later described. Coil clamps 30*a* and 30*b* surround the top portion of the forty meter resonator capacitor section and position immediately below the insulation assembly 32 respectively, and are secured thereto with nut and bolt assemblies in addition to securing the respective ends of the coil 30. A self-tapping screw 30*c* secures the top coil clamp 30*a* to the top portion of the forty meter resonator capacitor section 26. A lower end of a first metal section of hollow tubing 34 is of a diameter to telescope over the top portion of the forty meter resonator capacitor section 26 above the insulator assembly 32, and secures thereto with a self-tapping screw 35. A fifteen meter trap section 36 having a lower hollow tubular portion and including a lower slotted end 38 is of a diameter to telescope over the top of the hollow tubing 34, and is secured thereto with a hose clamp 39**.

A fifteen meter trap 40 having a coil 42 wound on a coil form **42*a* between two self-tapping screws 42*b* and 42*c* secures over an upper portion of the fifteen meter trap section 36 with a self-tapping screw 42*d* as later described. A second hollow metal section of tubing 44 having an upper slotted end 46 is of a diameter to telescope into the top of the fifteen meter trap section 36, and secures thereto with a self-tapping screw 48. A third hollow metal section of tubing 50 is of a diameter to telescope into the second hollow tubing 44, and secures within the slotted end 46 within a hose clamp 52. A fourth hollow metal section of tubing 54 is of a diameter to telescope into said third hollow section of tubing 50, and secures therein with a self-tapping screw 56. A fifth hollow metal section of tubing 58 is of a diameter to telescope into the fourth section of tubing 54, and secures therein with a self-tapping screw 60. An impedance matching coil 62 connects between the nut and bolt assembly 20 in the bottom of the eighty meter resonator capacitor section 18, and the nut and bolt assembly 16 in the top of the hollow tubular mounting post 12. A matching section length of seventy-five ohm coaxial cable transmission line 64 connects in parallel across the impedance matching coil, and terminates in a suitable coaxial plug such as a PL-259. An electrical ground connects to the nut and bolt assembly 16, and the metal hollow tubular mounting post 12. The metal portions of the vertical antenna 10** can be aluminum tubing of predetermined diameter by way of example and for purposes of illustration while the insulators can be fiberglass, polyethylene, etc. by way of example and for purposes of illustration as later described.

Figure 1C:
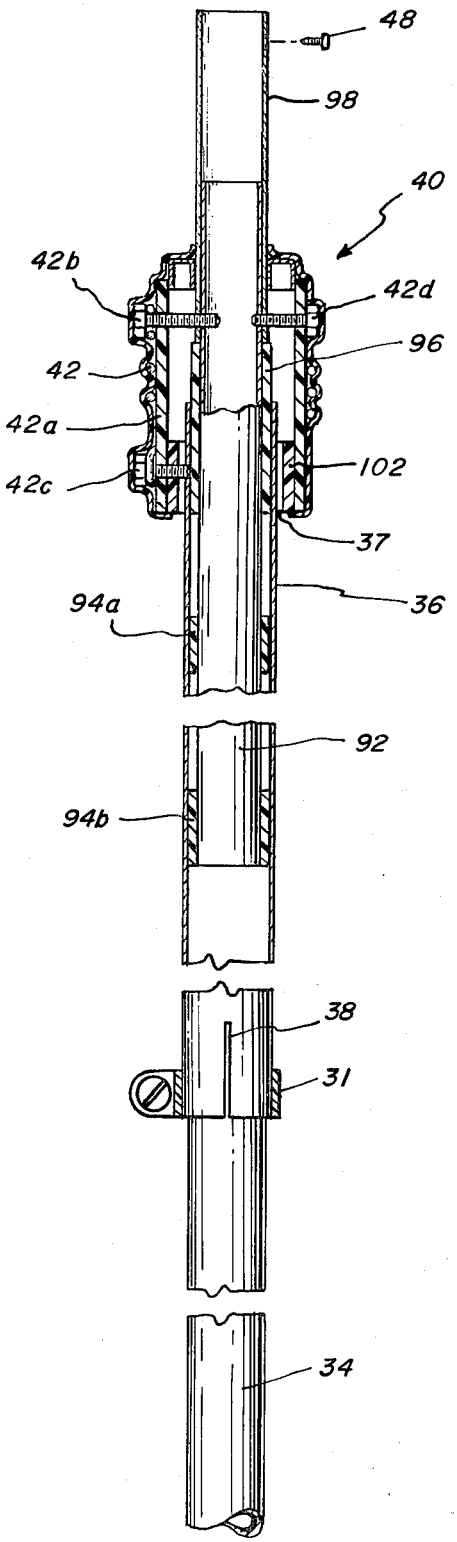
FIG. 1C illustrates a section of the present invention taken on the line 1C—1C of FIG. 1 looking in the direction of the arrows.
Figure 1A:
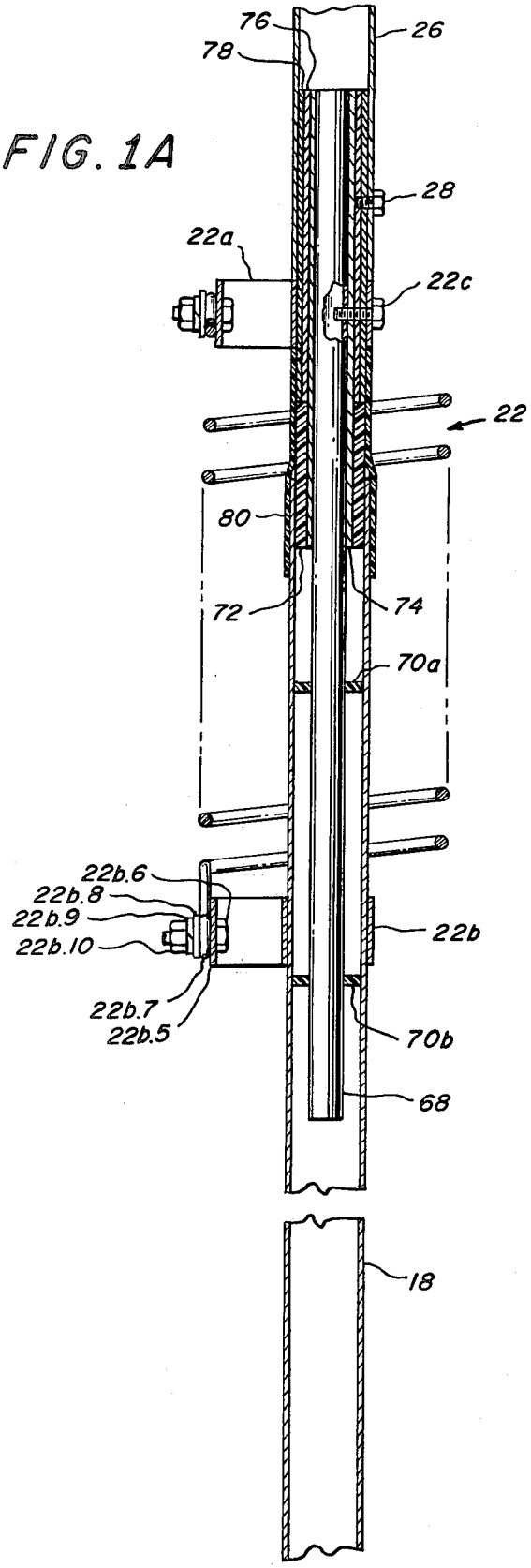
FIG. 1A illustrates a section of the present invention taken on the line 1A—1A of FIG. 1 looking in the direction of the arrows.

FIG. 1A, which illustrates a section of the vertical antenna taken on the line 1A—1A of FIG. 1 looking in the directions of the arrows, shows an internal metal tube 68 spaced by spacers 70*a* and 70*b* as illustrated in the figure from the eighty meter resonator capacitor metal section 18. An insulation sleeve 72, such as fiberglass by way of example and for purposes of illustration only, is accommodated between the eighty meter resonator capacitor section 18 and the internal tube 68. A first metal shim tube 74 of a predetermined diameter telescopes over the internal tube 68 and into the fiberglass sleeve 72. A second metal shim tube 76 of a predetermined diameter telescopes over the first metal shim tube 74 and abuts up against the top of the fiberglass sleeve 72. A third metal shim tube 78 of a predetermined diameter telescopes over the second metal shim tube 76 and abuts up against the top of the fiberglass sleeve 72. An insulation sleeve 80 such as polyethylene by way of example and for purposes of illustration only, extends and surrounds the fiberglass sleeve 72, and extends to a point just above the fiberglass sleeve 72 and to a point just below the top of the eighty meter resonator capacitor metal section 18. The top coil clamp 22*a* clamps around the third metal shim tube 78 and is electrically affixed thereto with the self-tapping sheet metal screw 22*c* which passes through the metal tubes 78, 76, 74 and 68 in order. The bottom metal coil clamp 22*b* being identical to the top coil clamp 22*a* clamps around the eighty meter resonator capacitor metal section 18 as later described in detail. The coil 22 of sixteen turns of aluminum tie wire by way of example and for purposes of illustration only on a four inch diameter connects between the top coil clamp and the bottom coil clamp 22*a* and 22*b* respectively. The coil clamp 22*b* includes overlapping flanges 22*b*.1 and 22*b*.2 illustrated in imaginary line having bolt holes 22*b*.3 and 22*b*.4 illustrated as overlapping to accept a nut and bolt assembly for clamping action. Additionally, an extending flange 22*b*.5 extends perpendicular to the overlapping flange 22*b*.1, and is provided with a hole to accept bolt 22*b*.6, the end of the coil wire 22*b*.7, a flat washer 22*b*.8, a lock washer 22*b*.9, and a nut 22*b*.10.

Figure 1B:
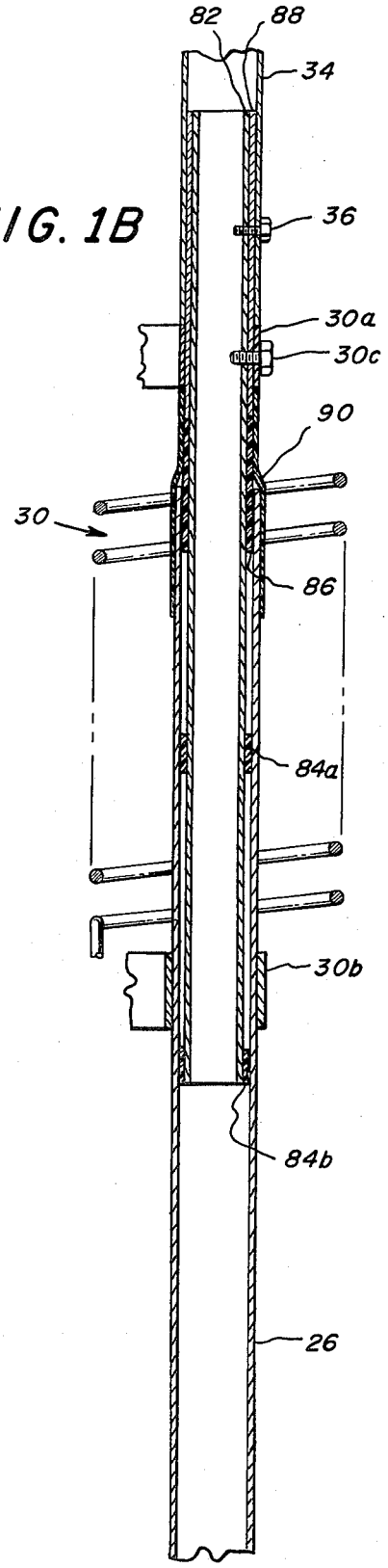
FIG. 1B illustrates a section of the present invention taken on the line 1B—1B of FIG. 1 looking in the direction of the arrows.

FIG. 1B, which illustrates a section of the vertical antenna taken on the line 1B—1B of FIG. 1 looking in the direction of the arrows, shows an internal metal tube 82 spaced by spacers 84*a* and 84*b* from the forty meter resonator capacitor metal section 26. An insulation sleeve 86 such as fiberglass by way of example and for purposes of illustration only is accommodated between the internal tube 82 and the forty meter resonator capacitor metal section 26. A first metal shim tube 88 telescopes over the internal metal tube 82 and abuts up against the top of the fiberglass sleeve 86. An insulation sleeve 90 such as polyethylene by way of example and for purposes of illustration only, extends and surrounds the fiberglass sleeve 86, and extends to a point just above the fiberglass sleeve 86 and to a point just below the top of the forty meter resonator capacitor metal section 26. The top coil clamp 30*a* clamps around the first metal shim tube 88 and is electrically secured thereto with the self-tapping screw 30*c* which passes through the metal tubes 82 and 88 in order. The bottom metal coil clamp 30*b* clamps around the forty meter resonator capacitor metal section 26. The coil 30 of eleven turns of aluminum tie wire by way of example and for purposes of illustration only, on a four inch diameter connects between the top and bottom coil clamps 30*a* and 30*b* respectively.

FIG. 1C, which illustrates a section of the vertical antenna taken on the line 1C—1C of FIG. 1 looking in the directions of the arrows, shows an internal metal tube 92 spaced by spacers 94*a* and 94*b* from the fifteen meter trap metal section 36. An insulation sleeve 96 such as fiberglass is accommodated between the fifteen meter trap section 36 and the internal tube 92. A first metal shim tube 98 telescopes over the internal tube 92 and abuts up against the top of the insulation sleeve 96. The fifteen meter trap 40 includes the coil 42 wound on the coil form 42*a* of suitable insulation which telescopes over the fifteen meter trap section 36, and secures thereto with self-tapping screws 42*b* and 42*d* through the metal shim tube 98 and the internal tube 92. Self-tapping screw 42*c* secures to metal section tube 36 through a metal shim ring 37 which telescopes over the tube section 36. An end cap 100 accommodates additional space between the coil form 42*a* and the metal shim tube 98. An insulation spacer 102 accommodates additional space between the coil form 42*a* and the metal section tube 36. The coil 42 consists of three turns of number twelve copper wire wound on the two inch diameter form 42*a*, and connects to the top and bottom screw 42*b* and 42*c* respectively.

Figure 2:
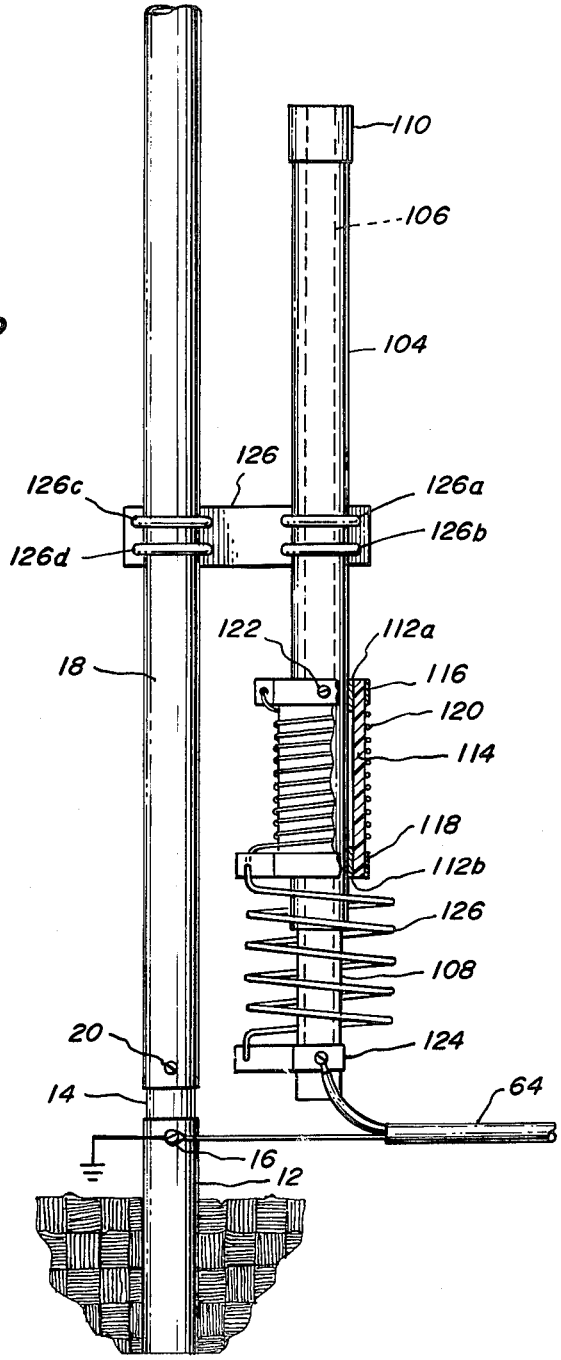
FIG. 2 illustrates a plan view of a one hundred and sixty meter tuning unit mounted at the base of the vertical antenna.

FIG. 2 which illustrates another embodiment of the vertical antenna shows a vertical plan view of a one hundred and sixty meter capacitor metal section 104 shows the internal metal tube 106 spaced from the one hundred and sixty meter capacitor section 104 by an insulation tube 108 such as polyethylene. An end cap 110 such as plastic covers the top of the tubes 104, 106 and 108 respectively. Two short metal shim rings 112*a* and 112*b* support a plastic coil form 114 which telescopes and slides over the one hundred and sixty meter capacitor section tube 104. An upper coil clamp 116 clamps around the top portion of the plastic coil form 114, and a middle coil clamp 118 clamps around the lower portion of the plastic coil form 114. A wire coil 120 of twenty-two turns of number fourteen close wound on the two inch diameter coil form connects between the upper coil clamp and the middle coil clamp as previously described. The coil 120 can be coated with ABS cement to retain proper coil spacing on the coil form 114. A self-tapping sheet metal screw extends through the upper coil clamp 116, the plastic coil form 114, the short metal tube or ring 112*a*, and the point of the self-tapping screw frictionally protrudes into the one hundred and sixty meter capacitor section tube 104. A lower coil clamp 124 clamps around the extending portion of the internal tube 106 below the polyethylene sleeve 108. A coil 126 of tie wire of ten turns on a four inch diameter connects between the middle and lower coil clamps 118 and 124 respectively. A bracket 126 with two pairs of U-bolt assemblies 126*a*–126*d* respectively fastens the one hundred and sixty meter capacitor section 104 to the eighty meter resonator capacitor section 18.

PREFERRED MODE OF OPERATION

The mounting post 12 of FIG. 1 is set into a suitable hole, approximately in the range of twenty-one inches deep, so that the upper end of the insulator 14 clears the ground by five or six inches. The earth is packed tightly around the mounting post and concrete can be utilized for additional strength.

A number eight one and three-quarter inch bolt 16 is passed through the braid lug of the coaxial cable impedance matching transmission line 64, through a flat washer, through the lower loop of the impedance matching coil 62, through another opposing flat washer, through the hole in the mounting post 12 and the insulator 14, and secured with a flat washer, a lock washer, and a number eight nut. The eighty meter resonator coil 22 has two clamps, one large **22*b* and one small 22*a*. Remove a bolt assembly from the large clamp 22*b* and spread the large clamp 22*b* slightly. The top of eighty meter resonator capacitor section 18 is first passed through the large clamp 22*b*, the eighty meter resonator coil 22, and then through the small clamp 22*a*. The larger clamp 22*b* is below the insulation 24. The screw hole in the small clamp 22*a* of eighty meter resonator coil 22 is aligned with the lower screw hole in the top of section 18, and secured with a number ten-twentyfour self-tapping screw 22*c* through the small clamp 22*a* into the eighty meter resonator capacitor section 18. The one-quarter inch by one inch bolt is replaced in the large clamp 22*b*, the large clamp 22*b* is slid down the eighty meter resonator capacitor section 18 to a predetermined position, and subsequently, the large clamp 22*b* is tightened. The forty meter resonator coil 30 is installed on the forty meter resonator capacitor section 26** in a like manner and tightened at a predetermined position.

The lower end of first metal section 34 telescopes onto the top of forty meter resonator capacitor section 26. The screw holes are aligned in the sections 34 and 26, and secured with a number ten-twentyfour self-tapping screw 35. The large stainless steel hose clamp 39 is positioned over the slotted end 38 of the fifteen meter trap section 36, and the two sections 36 and 34 telescope together. The distance between the trap coil 40 of the fifteen meter trap section 36 and the top of forty meter resonator coil 30 is adjusted to the range of five feet-eight inches, and the clamp 39 is tightened. The bottom of second metal section 44 telescopes into the top of fifteen meter trap section 36, and the screw holes are aligned and secured with a number ten-twentyfour self-tapping screw 48. The fourth metal section 54 telescopes into the third metal section 50, and the screw holes are aligned and secured with a number ten-twentyfour self-tapping screw 56. The fifth metal section 58 telescopes into the fourth metal section 54, and the screw holes are aligned and secured with a number six-thirtytwo self-tapping screw 60. The small stainless steel hose clamp 52 is positioned over the top slot end 46 of the second metal section 44. The bottom of the third metal section 50 telescopes into the top of the second metal section 44, the distance from the top of the trap decoupling coil 40 to the top of the fifth metal section 58 is adjusted to the range of thirteen feet-two inches, and the hose clamp 52 is tightened. The bottom of the eighty meter resonator capacitor section 18 is positioned over the top of the mounting post 12, and the screw holes aligned. A number eight by one and three-quarters inch bolt 20 is passed through the center lug of the coaxial cable impedance matching transmission line 64, through a flat washer, through the upper loop of the impedance matching coil 62, through another opposing flat washer, through the sections 18 and 14 and is secured with a flat washer, a lock washer, and a number eight nut. The assembly of sections 26–58 is raised and positioned atop by telescoping the bottom of the forty meter resonator capacitor section 26 over the top of the eighty meter resonator capacitor section 18, aligning the screw holes, and securing with a number ten-twentyfour self-tapping screw 28.

The vertical antenna 10 produces a very low standing wave ratio (SWR) readings over the twenty, fifteen, and ten meter bands, and the eighty-seventyfive and forty meter resonator circuits are predetermined and set for resonances of approximately 3700 and 7100 Khz. Inasmuch as some variation can be expected, the following procedure is utilized to adjust the vertical antenna 10 for minimum SWR at any desired point in each of the five bands of the HF spectrum. SWR readings can be taken at the transmitter end of the coaxial cable transmission feedline, or at the junction of the coaxial cable transmission feedline which is fifty-two ohm and the seventy-five ohm impedance matching transmission line 64 for greater accuracy.

The frequency of minimum SWR on fifteen meters is predetermined. To raise the frequency, the sliding sections 34 and 36 are telescoped closer together or to lower frequency, the sections 34 and 36 are slid further apart. The frequency of minimum SWR on twenty meters is predetermined. To raise or lower the frequency, the total length of sections 44 through 58 is adjusted by varying the amount of overlap between sections 44 and 50 a few inches. The frequency of minimum SWR on ten meters is predetermined. The twenty meter adjustment also determines the ten meter resonant frequency, but resonance on both bands is so broad that slight adjustments for the sake of improved SWR on one band does not significantly affect SWR on the other. The frequency of minimum SWR on forty meters is predetermined. Adjustment is made by loosening the lower clamp **30*b* of the forty meter resonator coil 30, and compressing or expanding the spacing between coil turns to lower or raise the frequency respectively. One half-inch of travel will move the frequency of minimum SWR by approximately seventy Khz. When the proper setting has been determined, the lower clamp 30*b* is tightened in place. The frequency of minimum SWR on eighty or seventy-five meters is predetermined. Adjustment is made in a like manner by repositioning the lower clamp 22*b* on the eighty-seventyfive meter resonator coil 22. When the proper setting has been determined and the lower clamp 22*b* is tightened, the impedance matching coil 62 is adjusted at the base of the vertical antenna 10 by spreading the turns farther apart or squeezing them closer together until the SWR drops to a minimum value. One adjustment of the impedance matching coil should suffice for operation over the entire 3500–4000 Khz range, provided that the necessary adjustments are made to the eighty-seventyfive meter resonator coil 22**. In general, the forty and eighty-seventyfive meter adjustments will not significantly affect adjustments previously made for twenty, fifteen, and ten meters. However, if the eighty-seventyfive meter tuning is readjusted for operation at a much higher or lower frequency, it may be necessary to readjust the forty meter tuning in order to maintain SWR of less than 2:1 at both band edges.

The one hundred sixty meter tuning unit 104 of FIG. 2 utilizes a combination of fixed and variable inductance in a high-capacitance parallel-tuned circuit to generate the inductive reactance required to resonate the vertical antenna 10 in the 1800–1850 Khz range. At higher frequencies of the HF spectrum, the one hundred and sixty meter tuning unit 104 produces decreasing values of capacitance reactance which virtually have no effect on twenty, fifteen and ten meter operation, and which exert only a slight detuning effect on eighty and forty meter operation. The hundred and sixty meter tuning unit 104 provides for simultaneous resonance in each of the six HF amateur bands of the HF spectrum.

The one hundred and sixty meter unit is installed as illustrated in the FIG. 2. The resonance frequency is adjusted by loosening the set screw 122 approximately one third turn counterclockwise and sliding coil assembly 114 upwards along the tubular capacitor thus pulling the turns of the air wound inductor slightly apart. The resonant frequency is lowered in an opposite like manner. Set screw 122 is retightened at the proper setting. On obtaining a setting for one hundred and sixty meter operation, it may be necessary to readjust the eighty and forty meter resonator circuits as previously described.

The vertical antenna 10 is constructed of commercially available components including aluminum tubing of $\frac{5}{8}$, $\frac{3}{4}$, $\frac{7}{8}$, 1 and $1\frac{1}{8}$ inch outer diameters of predetermined lengths, aluminum tie wire, polyethylene tubing, ABS cement, fiberglass sleeves and insulators, and the like components. The aluminum tubing can be 0.058 wall 6061—T6 leading to an antenna weight in the range of ten and one-half pounds. The height of the antenna is 26 feet. The eighty meter resonator capacitor section 18 is five and one-half feet; the forty meter resonator capacitor section is twenty inches; the first section 34 is one inch by thirty-three inches; the second section is three-quarters by four feet, top slotted; the third section is five-eighths by four feet with a screw hole in the top; the fourth section is one-half by four feet, with a large screw hole in the bottom and a small screw hole in the top, and; the fifth section is three-eighths by three feet with a screw hole in the bottom and the top closed.

The vertical antenna is capable of handling transmitter input power of 2000 watts SSB or 1000 watts CW on forty-ten meters, 1500 watts PEP or 500 watts CW on eighty-seventyfive meters. Fifty ohm coaxial cable transmission line connects to the impedance matching section 64. The VSWR at resonance is 1:5:1 or less with a VSWR 2:1 or less for forty through ten meters and 60–100 Khz on eighty meters.

Various modifications can be made to the vertical antenna of the present invention without departing from the apparent scope thereof.

Having thus described the invention, what is claimed is:

1. A vertical antenna for operation on five segments of the high-frequency spectrum comprising:

a. first resonator capacitor-inductor means vertically supported;

b. second resonator capacitor-inductor means vertically connected to said first resonator capacitor-inductor means;

c. first vertical radiating means connected to said second resonator capacitor-inductor means;

d. trap section telescoping radiating means vertically connected to said first vertical radiating means; and, e. second vertical telescoping radiating means connected to said trap means whereby a coaxial cable transmission line connects to said first resonator capacitor-inductor means and ground, and the entire vertical radiating length is active on all five of said high-frequency spectrum segments in addition to being a quarter wave resonance on the frequency corresponding to the trap.

2. The vertical antenna of claim 1 wherein said first resonator capacitor-inductor means comprises an eighty-seventy meter resonator capacitor section and including an eighty-seventyfive meter resonator inductor connected in parallel across the top of said capacitor section whereby said resonator adjusts the center frequency of operation.

3. The vertical antenna of claim 1 wherein said second resonator capacitor-inductor means comprises a forty meter resonator capacitor section and including a forty meter resonator inductor connected in parallel across the top of said capacitor section whereby said resonator adjusts the center frequency of operation.

4. The vertical antenna of claim 1 wherein said first vertical radiating means comprises a longitudinal metal tube.

5. The vertical antenna of claim 1 wherein said trap section telescoping radiating means comprises a fifteen meter resonator capacitor section including a fifteen meter trap coil connected in parallel across the top of said capacitor section and a slotted lower end to accept said first vertical radiating means whereby said telescoping of said section and said first radiating means adjusts the center frequency of operation.

6. The vertical antenna of claim 1 wherein said second vertical telescoping radiating means comprises a second, third, fourth, and fifth vertical radiating elements internally secured to each respective element, the top of said second element being slotted to accept the bottom of said third element, the bottom of said second element internally secured to said trap section radiating means whereby the telescoping of said second and third sections adjusts the center frequency of operation on twenty and ten meters.

7. The vertical antenna of claim 1 comprising an impedance matching coil connected across said first resonator capacitor means and ground.

8. The vertical antenna of claim 7 comprising a coaxial cable transmission line impedance matching section connected across said impedance matching coil.

9. A vertical antenna for operation on six segments of the high-frequency spectrum comprising:

a. first resonator capacitor means vertically supported;

b. second resonator capacitor means vertically affixed to said first resonator capacitor means;

c. third resonator capacitor section including a wide wound inductor in series with a close wound inductor, said inductors connected in parallel across said capacitor section, a mid-portion of said first resonator capacitor means connects to a mid-portion of said third resonator capacitor section;

d. first vertical radiating means affixed to said second resonator capacitor means;

e. trap section radiating means vertically affixed to said first vertical radiating means; and, f. second vertical radiating means affixed to said trap section radiating means whereby a coaxial cable transmission line connects between ground and the bottom of said third resonator capacitor section, and the entire vertical radiating length is active on all of said high-frequency spectrum segments in addition to being a quarter wave resonance on the frequency corresponding to said trap section radiating means.

10. The vertical antenna of claim 9 wherein said third resonator capacitor section comprises a one hundred and sixty meter tuning unit.

11. A vertical antenna for operation on the eighty-seventyfive, forty, twenty, fifteen and ten meter amateur bands of the high frequency spectrum comprising:

a. tubular support post including a solid fiberglass insulator extending therefrom and secured to said support post with a nut and bolt assembly;

b. eighty meter resonator capacitor section including an eighty meter resonator inductor supported at the top of said eighty meter resonator capacitor section and connected in parallel across said capacitor section and vertically supported on said insulator;

c. forty meter resonator capacitor section including a forty meter resonator inductor supported at the top of said forty meter resonator capacitor section and connected in parallel across said forty meter resonator capacitor section and vertically affixed to said eighty meter resonator capacitor section;

d. first vertical radiating element vertically affixed to the top of said forty meter resonator capacitor resonator section;

e. fifteen meter trap section including a fifteen meter trap coil to trap out the upper portion of said vertical antenna and a slotted bottom to telescope over said first vertical radiating element, and a hose clamp affixing said fifteen meter trap section vertical affixed to said first vertical radiating element;

f. second, third, fourth and fifth vertical radiating elements, said second element secured to the top of said fifteen meter trap section with a self-tapping sheet metal screw, said third element telescoped into said second element and secured thereto with a base clamp, said fourth element internally secured to said third element with a self-tapping sheet metal screw, and said fifth element internally secured to said fourth element with a self-tapping sheet metal screw whereby said eighty meter resonator adjusts the center frequency of operation on eighty meters, said forty meter resonator adjusts the center frequency of operation on forty meters, the center frequency of operation on twenty meters is adjusted by telescoping said third radiating element into said second radiating element, the center frequency of operation on fifteen meters adjusted by telescoping the fifteen meter trap section over the first radiating element, and the center frequency of operation on ten meters is adjusted by telescoping said third radiating element into said second radiating elements for low voltage standing wave ratio on each of the center frequencies.

12. The vertical antenna of claim 11 comprising a one hundred and sixty meter tuning unit including a one hundred and sixty meter resonator capacitor section and a first wide wound inductor connected in series with a second close wound inductor, said two series inductors connected in parallel across said one hundred and sixty meter resonator capacitor section where said first inductor is positioned at the bottom of said section and said second inductor is positioned over said section, a mid-portion of said eighty meter resonator capacitor section connects to a portion of the one hundred and sixty meter resonator capacitor section, and an impedance matching coaxial cable transmission line connects between the top of the one hundred and sixty meter capacitor section and the support post.

* * * * *